US007980405B2

(12) United States Patent
An

(10) Patent No.: US 7,980,405 B2
(45) Date of Patent: Jul. 19, 2011

(54) INDIVIDUALLY DETACHABLE CONTAINER PACK

(76) Inventor: Hei Jun An, Los Angeles, CA (US)

( * ) Notice: Subject to any disclaimer, the term of this patent is extended or adjusted under 35 U.S.C. 154(b) by 629 days.

(21) Appl. No.: 12/155,660

(22) Filed: Jun. 6, 2008

(65) Prior Publication Data

US 2009/0166316 A1 Jul. 2, 2009

Related U.S. Application Data

(60) Provisional application No. 61/006,177, filed on Dec. 28, 2007.

(51) Int. Cl.
*B65D 21/028* (2006.01)
*B65D 21/02* (2006.01)

(52) U.S. Cl. ..... 220/23.4; 220/23.8

(58) Field of Classification Search ..... 220/23.4, 220/4.27, 23.8, 916; 264/157, 527
See application file for complete search history.

(56) References Cited

U.S. PATENT DOCUMENTS

| | | | | |
|---|---|---|---|---|
| 3,780,856 | A | 12/1973 | Braverman | |
| 3,862,698 | A * | 1/1975 | Hafele | 428/542.8 |
| 4,954,310 | A * | 9/1990 | Andersen | 264/520 |
| D330,326 | S | 10/1992 | Honeycutt | |
| 5,279,841 | A | 1/1994 | Yu | |
| 5,503,885 | A * | 4/1996 | Anderson | 428/35.7 |
| 5,544,778 | A * | 8/1996 | Goncalves | 220/23.4 |
| 5,573,133 | A | 11/1996 | Park | |
| D413,264 | S | 8/1999 | Uechi | |
| D422,848 | S | 4/2000 | Hansen | |
| 6,047,756 | A * | 4/2000 | Uchida | 156/393 |
| 6,426,035 | B1 * | 7/2002 | Hansen | 264/525 |
| 6,434,812 | B1 * | 8/2002 | Andersson et al. | 29/417 |
| 6,517,768 | B1 * | 2/2003 | Weiler | 264/524 |
| 6,530,301 | B1 * | 3/2003 | Seitz et al. | 83/23 |
| 6,629,834 | B2 * | 10/2003 | Cargile et al. | 425/532 |
| 6,675,680 | B1 * | 1/2004 | Seitz et al. | 83/23 |
| D487,697 | S | 3/2004 | Rosen | |
| 6,971,521 | B2 | 12/2005 | Pinyot | |
| 7,752,947 | B2 * | 7/2010 | Fiorani et al. | 83/13 |
| 2003/0155356 | A1 * | 8/2003 | Fontana | 220/23.4 |
| 2005/0023237 | A1 | 2/2005 | Inestroza | |
| 2007/0017893 | A1 | 1/2007 | Ihli | |

FOREIGN PATENT DOCUMENTS

| | | |
|---|---|---|
| WO | WO9625336 | 8/1996 |

* cited by examiner

*Primary Examiner* — Mickey Yu
*Assistant Examiner* — Niki M Eloshway
(74) *Attorney, Agent, or Firm* — Richard C. Litman

(57) ABSTRACT

The individually detachable drink pack includes a plurality of beverage containers aligned in a substantially linear fashion. A tab is disposed about the periphery of the cap and/or base of each container and extends to the next container, attaching to the next container's base or cap to another tab. In this manner, the containers are attached end to end, or may be branched to start a side chain of containers, also linked end to end. Each tab is relatively thin and flexible, having sufficient strength to normally keep the containers connected, yet being frangible such that the tab may be broken by being bent or torn, thus allowing consecutive beverage containers to be separated and the contents thereof consumed.

15 Claims, 5 Drawing Sheets

INDIVIDUALLY DETACHABLE CONTAINER PACK

CROSS-REFERENCE TO RELATED APPLICATION

This application claims the benefit of U.S. Provisional Patent Application Ser. No. 61/006,177, filed Dec. 28, 2007.

BACKGROUND OF THE INVENTION

1. Field of the Invention

The present invention relates to beverage or other containers. In particular, the present invention relates to an individually detachable drink pack that has a plurality of continuously attached beverage containers that may be detached one at a time by removing a connecting tab.

2. Description of the Related Art

Beverage containers are well known to be available in a variety of shapes and sizes, as well as containing several ingredients. For example, it is common to purchase a twelve-ounce aluminum can of soda from a vending machine or a five-ounce plastic bottle of alcohol from a flight attendant. Beverage containers are typically sold individually or packaged in bulk, like a six-pack with plastic ring attachments or a case with twenty-four containers in a box, for example.

Although it is convenient to purchase and carry one beverage container, it is often more cost effective to purchase in bulk. When buying in bulk however, a consumer is left with packaging to dispose of, which generally creates more waste, some of which has been known to cause harm to wildlife. Furthermore, many bulk-packaging articles are less attractive than the designer-type individual containers the packaging houses. Thus, an individually detachable container pack solving the aforementioned problem is desired.

SUMMARY OF THE INVENTION

The individually detachable container pack includes a plurality of beverage or other containers aligned in a substantially linear fashion. A tab is disposed about the periphery of the cap and/or base of each container and extends to the next container, attaching to the next container's base or cap or, alternatively, to another tab. In this manner, the containers are attached end to end, or may be alternatively branched to start a side chain of containers that are linked end to end. Each tab is relatively thin and flexible, having sufficient strength to normally keep the containers connected, yet frangible so that the tab may be broken by being bent or torn, thus allowing consecutive beverage containers to be separated and the contents thereof consumed.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
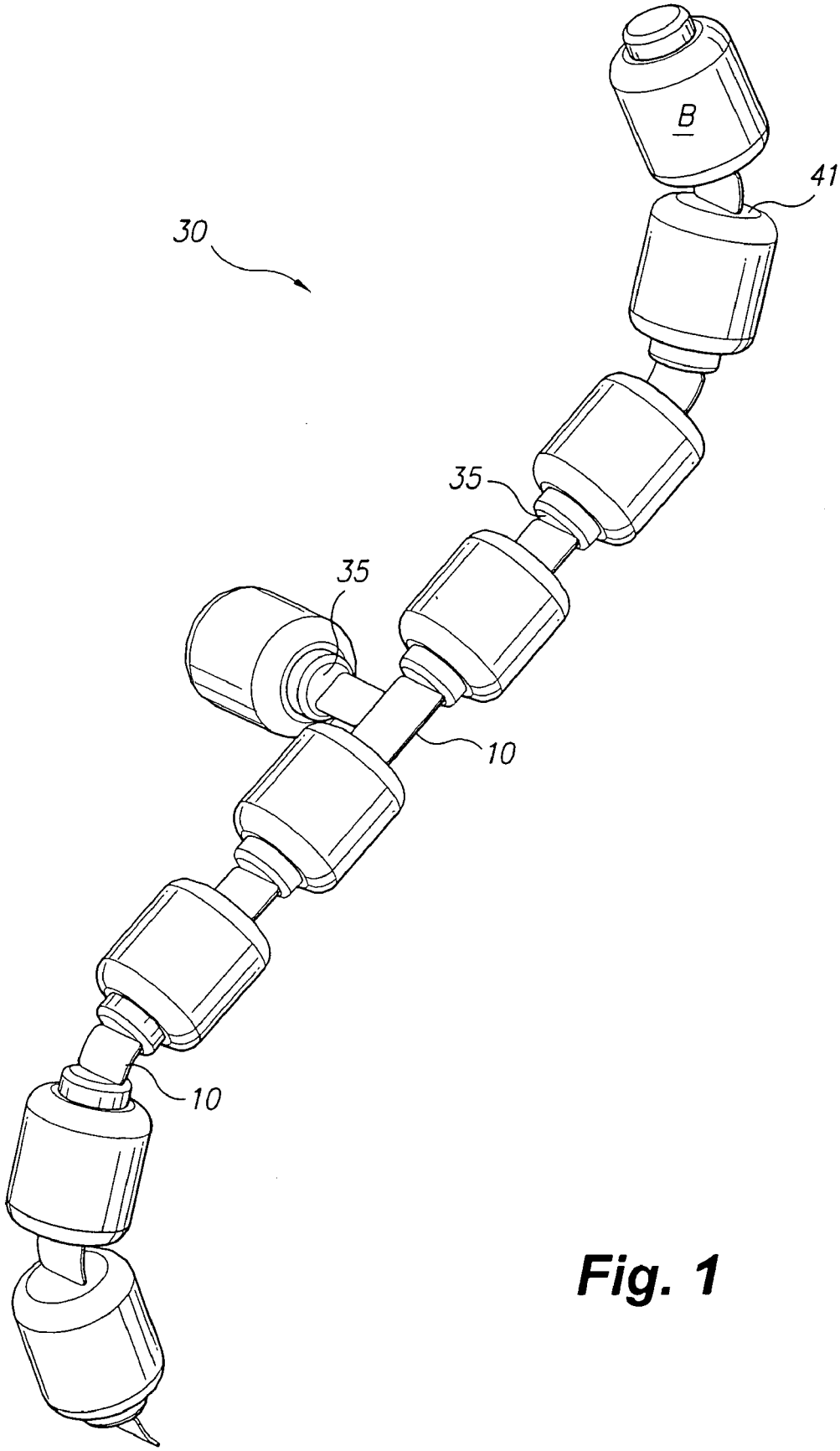
FIG. 1 is a perspective view of an individually detachable container pack according to the present invention.
Figure 2:
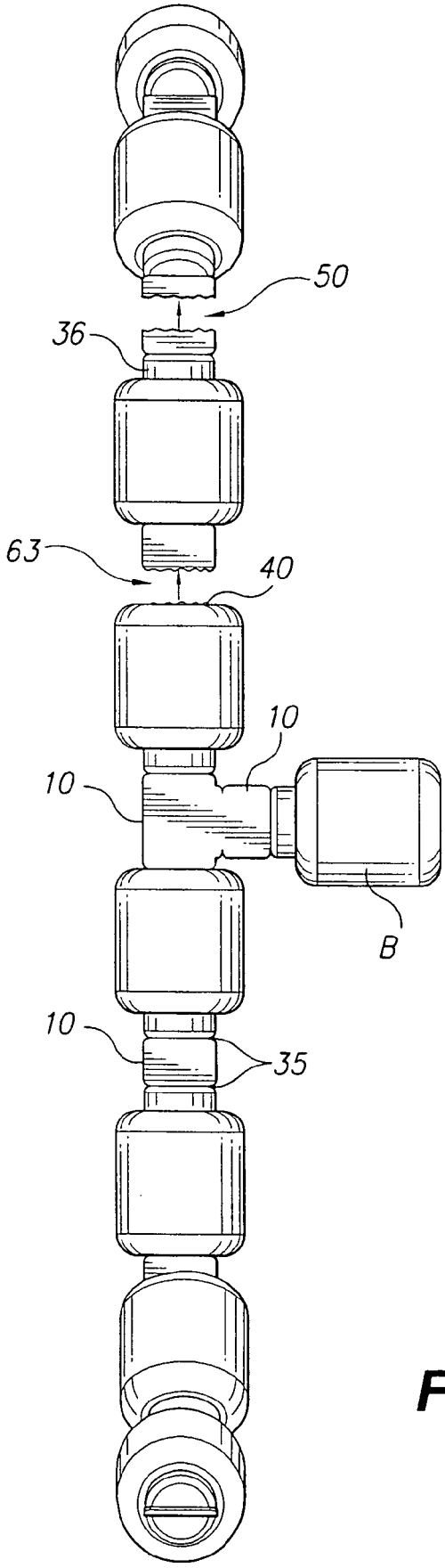
FIG. 2 is a front view of the individually detachable container pack according to the present invention.
Figure 3:
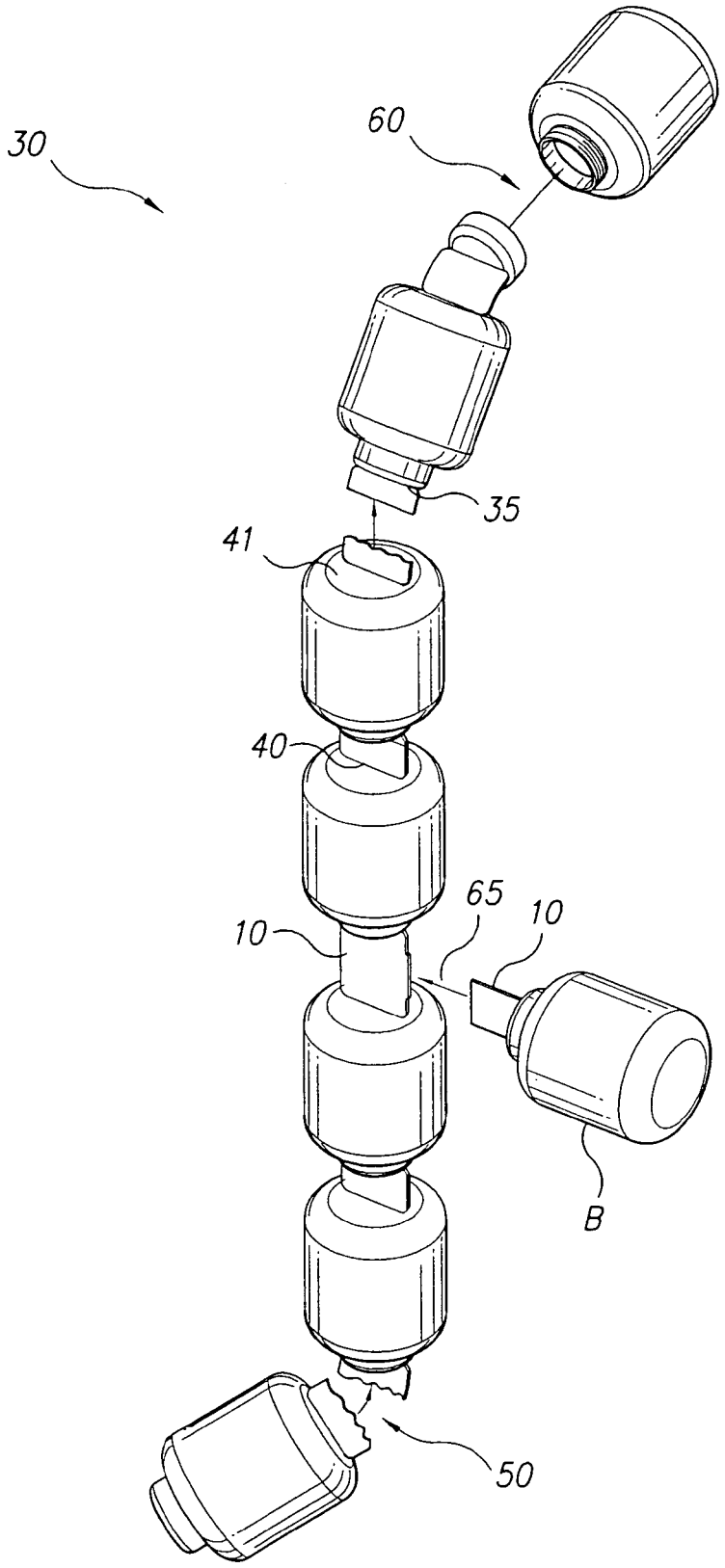
FIG. 3 is a perspective view of the individually detachable container pack according to the present invention, showing individual beverage containers being detached from opposite ends of the pack and from a side chain of the pack.

The present invention is directed towards an individually detachable container pack, designated generally as 30 in the drawings. As shown in FIGS. 1-3, an exemplary beverage container B has a tab 10 attached to the periphery of its cap 36 and/or base 41. The tab 10 connects the container B to an adjacent one of the other containers B in the chain. As shown in the drawings, the containers B are generally arranged in a substantially linear fashion and can be joined in a top-to-base or end-to-end chain. Thus, containers B may be connected in the sequence of top 36 to tab 10 to bottom 41, base 41 to tab 10 to base 41, top 36 to tab 10 to top 36, or in any variation thereof. Further, one tab 10 may be connected normal to another tab 10 to form a side chain of one or more beverage containers, as shown. The individually detachable container pack 30 may therefore be connected to form a wide variety of designs and configurations. The containers and tabs may be formed from plastic or any other suitable material.

Tab 10 is preferably formed from a bendable and relatively thin, yet strong, plastic or any other suitable material which will keep the chain intact, and is preferably frangible so that the tab 10 will break to alter an individually detachable drink pack 30, or to detach a bottle B therefrom for consumption. FIG. 3 shows an example of tab 10 torn at the center 50 of a top-to-base sequence. FIG. 3 further illustrates tab 10 being bent until snapped to break, as indicated by arrow 65. Similarly, tab 10 may be broken (i.e., torn or snapped) at its junction 40 with the container top or bottom, as indicated by the break 63 shown in FIG. 2. Tab 10 may be perforated, slit, tapered, or otherwise weakened, either at its center or at its junction with a beverage container top or bottom, in order to make tearing, snapping, etc. easier. Tab 10 may also be replaced with a string, wire, tape, or any other similar material capable of bending and or being broken and removed. As shown in FIG. 3, a bottle can be separated from the drink pack, alternatively, by removal of cap 60.

Figure 4A:
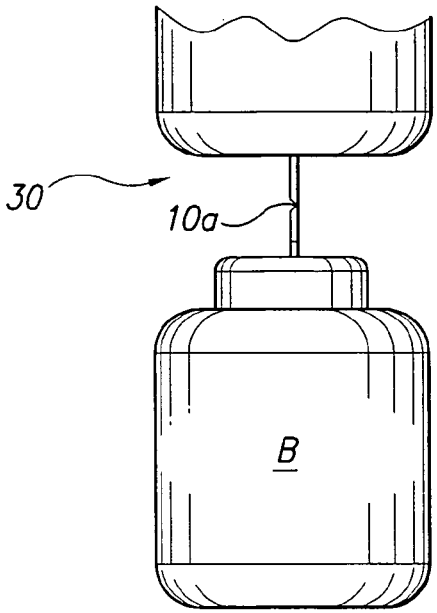
FIGS. 4A, 4B, 4C and 4D illustrate an alternative embodiment of an individually detachable container pack according to the present invention in which the frangible tab connecting beverage containers can be used as a pull tab to open the detached beverage container.
Figure 4B:
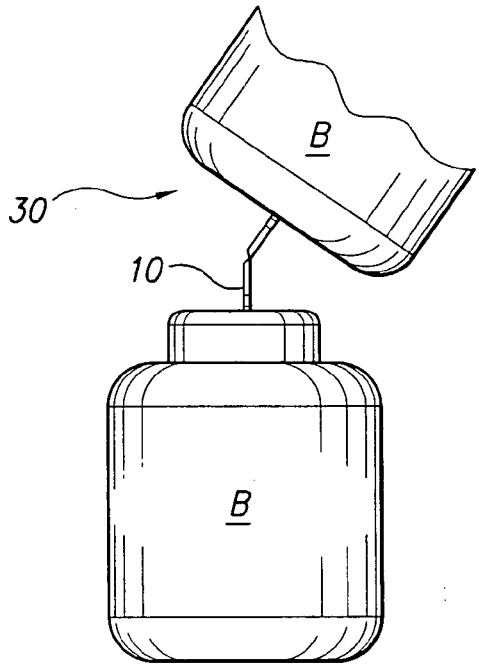
Figure 4C:
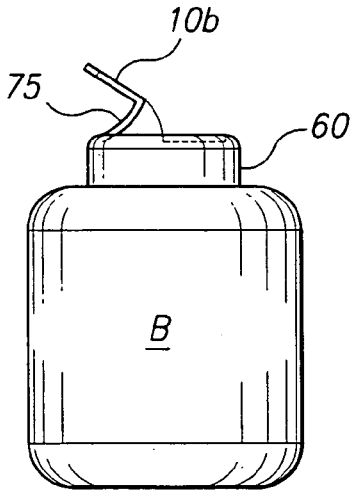
Figure 4D:
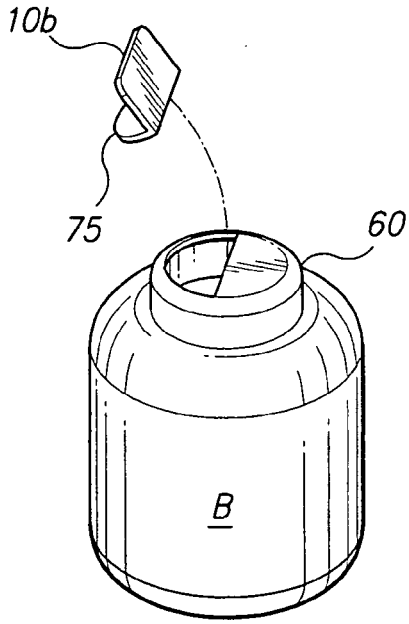

Alternatively, after breaking the tab 10 to remove a beverage container B, the tab 10, or a major portion of the tab 10, may be retained on the top of the beverage container B and used as a pull tab to open the container B to consume the beverage. An example of this embodiment is shown in FIGS. 4A through 4D, in which the tab 10 connecting adjacent beverage containers B has a groove or thinned area 10*a* permitting the tab 10 to be more easily broken or torn in order to separate a single container B from the chain of containers in the pack 30. In FIG. 4B, the tab 10 is bent about area 10*a* in order to break away the upper beverage container B. As shown in FIGS. 4C and 4D, the portion 10*b* of the tab 10 remaining after separation of the container from the pack 30 can then be used as a pull tab to open cap 60 in order to drink the beverage. As shown in FIG. 4D, portion 10*b* is preferably completely removed, along with a breakaway or tearaway portion 75.

Although shown in the drawings as a pull tab which leaves a semicircular opening in the cap 60 for drinking the beverage (for example, by perforating the cap 60 or creating thinned grooves or tear lines in the cap 60, forming a semicircular cutout), it should be understood that both the breakaway portion 75 of the cap 60 that may be removed by the pull tab and the resulting opening formed in the cap 60 may have any desired practicable shape.

Figure 5:
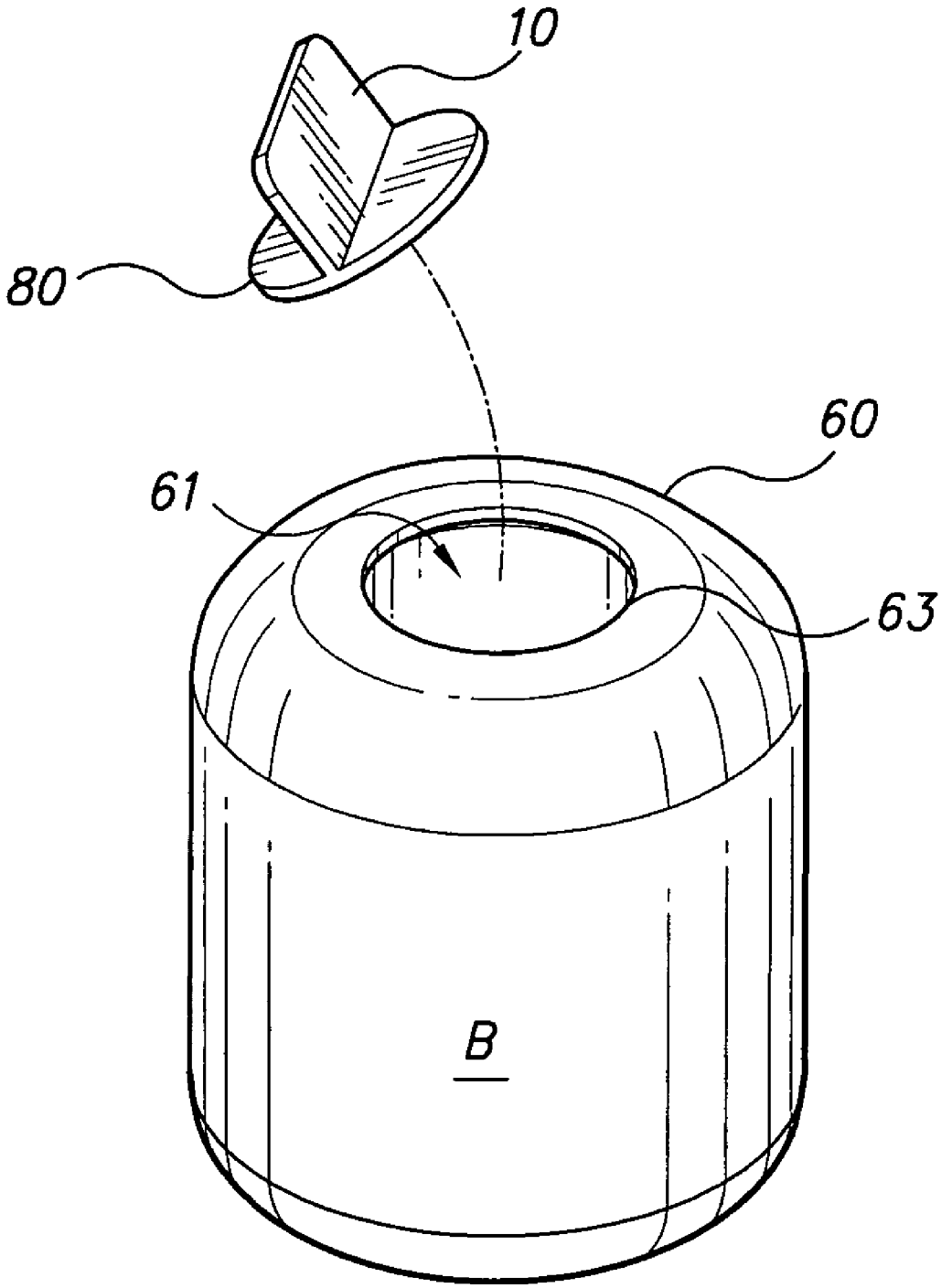
FIG. 5 is a perspective view of another alternative embodiment of the individually detachable container pack according to the present invention.

In the alternative embodiment of FIG. 5, the cap or upper portion 60 of bottle B has a substantially flat surface, with a central portion about opening 61 formed from a relatively thin or weak material (or, as described above, having a frangible periphery), allowing tab 10 to be used as a pull tab or gripping handle for removal of sealing portion 80 from annular edge 63. Tab 10 is folded or bent, allowing the user to remove sealing portion 80 of cap portion 60 due to the thin or structurally weak nature of the cap portion 60.

It is to be understood that the present invention is not limited to the embodiments described above, but encompasses any and all embodiments within the scope of the following claims.

I claim:

1. An individually detachable container pack, comprising:

a first container having a pair of opposed ends;

a second container having a pair of opposed ends;

a tab frangibly attaching one of the ends of the first container to one of the ends of the second container, the tab having sufficient strength to form the containers into a chain for transport and storage, the tab being frangible to permit detaching containers from the chain individually;

a third container; and a side tab having opposed first and second ends, the first end of the side tab being secured to a side surface of the tab joining said first and second containers, the second end of the side tab being secured to the third container, the side tab frangibly joining the third container to the tab.

2. The individually detachable container pack as recited in claim 1, wherein each of said first and second containers has opposed upper and lower ends, the tab releasably joining the upper end of said first container to the lower end of said second container.

3. The individually detachable container pack as recited in claim 2, wherein said tab is frangible at a junction between said tab and the upper end of said first container.

4. The individually detachable container pack as recited in claim 2, wherein said tab is frangible at a junction between said tab and the lower end of said second container.

5. The individually detachable container pack as recited in claim 2, wherein said tab is frangible about a central portion thereof.

6. The individually detachable container pack as recited in claim 1, wherein each of said first and second containers has opposed upper and lower ends, the tab releasably joining the upper end of said first container to the upper end of said second container.

7. The individually detachable container pack as recited in claim 6, wherein said tab is frangible at a junction between said tab and the upper end of said first container.

8. The individually detachable container pack as recited in claim 6, wherein said tab is frangible at a junction between said tab and the upper end of said second container.

9. The individually detachable container pack as recited in claim 6, wherein said tab is frangible about a central portion thereof.

10. The individually detachable container pack as recited in claim 1, wherein each of said first and second containers has opposed upper and lower ends, the tab releasably joining the lower end of said first container to the lower end of said second container.

11. The individually detachable container pack as recited in claim 10, wherein said tab is frangible at a junction between said tab and the lower end of said first container.

12. The individually detachable container pack as recited in claim 10, wherein said tab is frangible at a junction between said tab and the lower end of said second container.

13. The individually detachable container pack as recited in claim 10, wherein said tab is frangible about a central portion thereof.

14. The individually detachable container pack as recited in claim 1, wherein said first container has an upper end defining a removable cover, said tab being secured to the upper end, whereby the tab acts as a gripping member for removing the removable cover.

15. The individually detachable container pack as recited in claim 14, wherein the removable cover includes a frangible portion, the tab being secured to the frangible portion.

* * * * *